United States Patent [19]

Jonker

[11] Patent Number: 4,905,859

[45] Date of Patent: Mar. 6, 1990

[54] METAL PACKAGING CAN AND METHOD OF MAKING IT

[75] Inventor: Frederik Jonker, Heemskerk, Netherlands

[73] Assignee: Hoogovens Groep B.V., Ijmuiden, Netherlands

[21] Appl. No.: 366,533

[22] Filed: Jun. 15, 1989

[30] Foreign Application Priority Data

Jun. 27, 1988 [NL] Netherlands ..... 8801625

[51] Int. Cl.[4] ..... B65D 8/00

[52] U.S. Cl. ..... 220/67

[58] Field of Search ..... 220/83, 1 BC, 66, 67, 220/74, 76, 79

[56] References Cited

U.S. PATENT DOCUMENTS

| | | | |
|---|---|---|---|
| 1,323,254 | 12/1919 | Downs | 220/67 |
| 2,196,206 | 4/1940 | Foss | 220/67 |
| 2,432,790 | 12/1947 | O'Larte et al. | 220/67 X |
| 3,709,399 | 1/1973 | Hughes | 220/67 |

FOREIGN PATENT DOCUMENTS 2464887 3/1981 France .

OTHER PUBLICATIONS

H. Fujimori, "Forming Method for Can Opening Part, and Roll Forming Device Used for said Method", Patent Abstracts of Japan, vol. 7, No. 250(M-254)1395 11/8/83.

*Primary Examiner*—Steven M. Pollard

*Attorney, Agent, or Firm*—Stevens, Davis, Miller & Mosher

[57] ABSTRACT

Metal packaging can body, for use in forming a can by attachment of at least one lid, has a generally cylindrical body portion and a flanging rim which is intended for the subsequent attachment of the body portion to the lid. The flanging rim is at least partly of wall thickness greater than that of the body portion. To save material and costs, the flanging rim has at least one portion which decreases in wall thickness in the axial direction away from said body portion. The invention is especially applicable to deep-drawn and ironed products.

14 Claims, 1 Drawing Sheet

METAL PACKAGING CAN AND METHOD OF MAKING IT

BACKGROUND OF THE INVENTION

1. FIELD OF THE INVENTION

The invention relates to a metal packaging can body which is suitable to be provided with a lid and to a can formed therefrom by attaching a lid. The can body has a generally cylindrical body portion provided on at least one axial end with a thicker flanging rim for attachment of a lid by flanging. The invention also relates to a method of making such a can body.

2. DESCRIPTION OF THE PRIOR ART

A metal packaging can as described above is known from for example DE-A-2,140,131. That publication describes a cylinder-shaped conventional packaging can with a flanging rim of constant thickness. However, the present invention also relates to packaging cans with a narrowing at one end of the body portion onto which a smaller lid fits as a result.

A problem is manufacturing packaging cans is that, because of the deep-drawing and wall-ironing of the basic metal blank, its material hardens, so that the flanging rim of the can tends to crack.

It is constantly sought to reduce the cost price of a packaging can and to this end efforts are being made to provide the packaging can with a thinner wall, thereby saving material. This requires a greater thickness reduction in wall-ironing and means that the risk of cracking increases during production of the can.

It is mentioned that Derwent Abstract Vol. 7, No. 250 (M-254)(1395) Nov. 8, 1983 of JP-A-58-135730 shows a can body of uniform wall thickness except for a portion of reduced thickness at its mouth. This portion is outwardly rolled to strengthen the mouth.

SUMMARY OF THE INVENTION

The object of the invention is to achieve a reduction in consumption of the can material with minimal or no increase in the risk of cracking.

Briefly, in accordance with the invention, the thickness of at least one portion of the flanging rim decreases in the axial direction away from the can body portion.

The invention is based on the general concept that, by reducing the amount of material of which the can consists, the cost of the can is also reduced. For this, however, conditions other than those mentioned must also be kept in mind. It must still be possible to produce the proposed packaging can in a technically economical way. Changing the dimensions of the can also necessitates adjustments in the wall-ironing apparatus, which of itself adversely affects the production costs. At the same time attention has to be paid to the good workability of the can. A large variation in the thickness of the flanging rim may in practice lead to wrinkling, so that a lid can no longer be fitted to the can. The present invention reduces the overall material content of the can body, by thickness reduction of part of the flanging rim, while taking all these matters into consideration.

Preferably the axial length of the portion of the flanging rim which decreases in thickness is at least 2 mm, e.g. 2 to 10 mm, more preferably at least 4 mm. This portion may adjoin, at its thicker end, a portion of the flanging rim of constant wall thickness, which is the maximum thickness of the rim. This improves workability of the rim. The axial length of this portion of constant wall thickness is preferably at least 1 mm, more preferably at least 2 mm, and may be as much as 10 mm or more. The maximum thickness of the rim is preferably in the range 0.12 to 0.15 mm, more preferably at least 0.135 mm, compared with a typical thickness of the can body portion of 0.08 to 0.12 mm e.g. 0.10 mm.

Axially more remote from the can body portion than said portion which decreases in thickness, the rim may have a portion of uniform thickness less than the maximum thickness of the rim.

Good workability is further enhanced if the rim of the can has a diverging portion with a constant wall thickness between the edge and the portion of the rim which decreases in thickness. It has been found that the thickness of the diverging part is preferably in the range 0.11 to 0.125 mm, e.g. 0.115 mm.

The invention also provides a method of making such a can body, by deep-drawing and ironing a metal blank into the specified shape and then trimming the flanging rim while leaving at least part of its portion of maximum thickness. The invention extends to the can body, as a semi-finished product, both before and after such trimming to remove the rough edge resulting from deep-drawing and ironing and also before and after attachment of a lid.

The invention is applicable for example to can bodies made of tinplate or aluminium, preferably tinplate.

BRIEF INTRODUCTION OF THE DRAWINGS

The invention will now be illustrated by reference to the drawings which show non-limitative embodiments. In the drawings.

DESCRIPTION OF THE PREFERRED EMBODIMENTS

Figure 1:
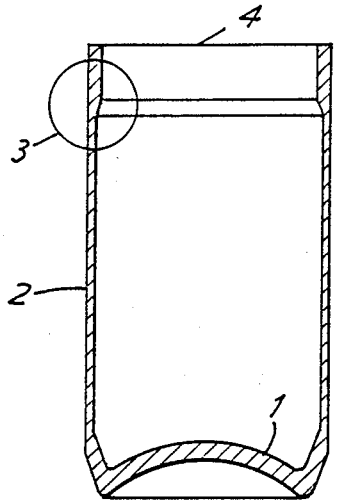
FIG. 1 shows a cross-section of a conventional packaging can body, suitable for attachment of one lid.

FIG. 1 shows a conventional can body with a bottom 1 and body portion formed of a cylindrical wall 2 of constant thickness of 0.10 mm and, at the axial end of the wall 2 opposite the bottom 1, a flanging rim 3 of larger constant thickness. The flanging rim 3 has an upper end 4. In use of the can body shown in FIG. 1, the contents of the can are inserted and then the can is closed by means of a lid, not shown, which is secured by a flanging operation on the flanging rim 3. This flanging operation is conventional and need not be described. The can body is made by deep-drawing and ironing.

Figure 2A:
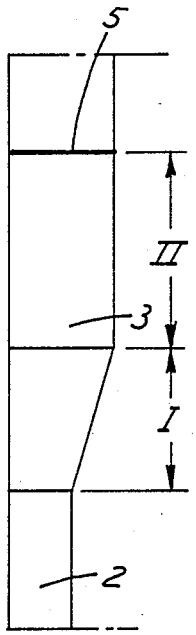
FIG. 2A is a detail of the conventional packaging can of FIG. 1 and FIGS. 2B and 2C are corresponding details of packaging can bodies embodying the present invention.

The detail of the transition region from the wall 2 to the flanging rim 3 circled in FIG. 1 is shown enlarged in FIG. 2A. The rim 3 has a greater wall thickness than the wall 2, since at the end of the wall 2 there is a portion I of gradually increasing thickness which ends at the portion II which is of constant thickness. FIG. 2A shows the trimming line 5 at which the can body is cut after the deep-drawing and ironing, to remove the rough edge produced by these operations. The portion II extends from portion I to the trimming line 5. The amount of material beyond the trimming line depends upon the deep drawing and ironing operation, and before trimming ends at a rough edge.

Figure 2B:
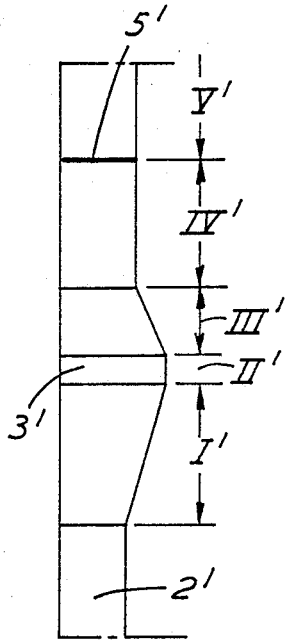
FIG. 2 shows details in section of wall portions of can bodies at the junction of the body portion and the flanging rim as indicated in FIG. 1.

FIG. 2B shows the corresponding portion of a packaging can body in accordance with the invention, this can body otherwise being the same as that of FIG. 1 and produced in the same way. The wall 2' of the body portion of the can body has the same thickness of 0.10 mm. From the upper end of this wall 2', there extends a portion I' of increasing thickness and of axial length 10 mm which merges into a short portion II' of maximum thickness of the flanging rim 3'. This short portion II' has an axial length of approximately 2 mm and a thickness of approximately 0.135 mm. At the end of this short portion II', it is adjoined by a portion III' of decreasing wall thickness which extends over an axial length of approximately 4 mm and then itself joins into a portion IV' with a constant thickness which extends as portion V' to the edge of the can (not shown). This constant thickness is approximately 0.125 mm. The trim line 5 separates the portion IV' from the portion V'.

It can be seen from comparison of FIGS. 2A and 2B that there is a saving of material in the case of FIG. 2B, represented by the reduced thickness of the portions III', IV' and V' in the case of FIG. 2B. It has been found that reduction of material used and costs may be of the order of 4%.

Figure 2C:
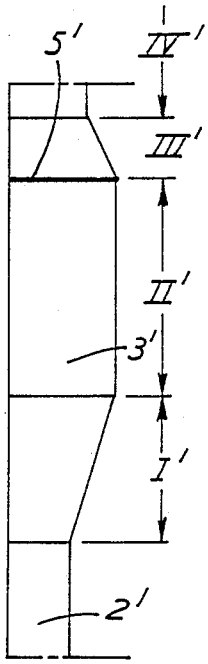

FIG. 2C shows an alternative embodiment of the invention. In this case the thickest portion II' of the flanging rim 3 extends from the end of the thickness increasing portion I' to the trim line 5, this being identified in FIG. 2C as portion II' and having an axial length of 10 mm. Apart from this the dimensions of the various portions of the can are identical to those of FIG. 2B. For example the thickness of the portion IV' which extends to the can edge is 0.125 mm. As compared with FIG. 2A the saving of material in this embodiment is less than in the case of FIG. 2B, but still a saving of material used and associated costs of 1.4% is obtainable.

It will be seen that in the embodiments of the invention shown, and in the conventional case of FIG. 2A, the outer surface of the can is cylindrical, while the inner wall has sloping transitions between the portions of differing thicknesses. In an alternative embodiment of the invention, there is a diverging part of the flanging rim, of uniform thickness but increasing diameter, at a location axially between the portion II of decreasing thickness and the edge of the can body.

In both FIGS. 2B and 2C, the flanging rim is intended as in the case of FIG. 2A for attachment to a lid in a flanging operation.

The techniques used for deep-drawing and wall-ironing of the embodiments of the invention are conventional, and need not be described. The same applies to the trimming operation and to the flanging operation to attach a lid.

It should be noted that the attached drawings are not drawn exactly to scale. The dimensions are given in this description.

What is claimed is:

1. Metal packaging can body, for use in forming a can by attachment of at least one lid, comprising a body portion having opposite axial ends and at at least one said end a flanging rim which is intended for the subsequent attachment of said body portion to said lid by flanging of at least part of the flanging rim, said flanging rim being at least partly of wall thickness greater than that of the body portion and including at least one portion which decreases in wall thickness in the axial direction away from said body portion.

2. Can body according to claim 1 which is a deep-drawn and ironed product.

3. Can body according to claim 2 from which the rough edge formed by deep-drawing and ironing has been removed.

4. Can body according to claim 2 from which the rough edge formed by deep-drawing and ironing has been removed.

5. Can body according to claim 1 having as seen in cross section, a cylindrical outer face and on its inner face a sloping transition from said body portion to said flanging rim of greater wall thickness, and wherein said portion of the flanging rim which decreases in wall thickness also has a sloping inner face.

6. Can body according to claim 1 wherein the axial length of said portion which decreases in wall thickness is at least 2 mm.

7. Can body according to claim 1 wherein said flanging rim has an axially extending portion of constant wall thickness, which thickness is the maximum wall thickness of the flanging rim, said portion which decreases in wall thickness adjoining said portion of constant wall thickness at the axial end thereof remote from the body portion.

8. Can body according to claim 7 wherein said portion of constant wall thickness has a thickness in the range 0.12 to 0.15 mm.

9. Can body according to claim 7 wherein said portion of constant wall thickness has an axial length of at least 1 mm.

10. Can body according to claim 1 wherein at a region axially more remote from the can body than said portion which decreases in wall thickness, said flanging rim has a diverging portion which is of constant wall thickness and gradually increasing diameter.

11. Can body according to claim 10 wherein said diverging portion has a wall thickness in the range 0.11 to 0.125 mm.

12. Can body according to claim 1 further having a lid secured to said body by flanging of said flanging rim.

13. Metal packaging can body for attachment to a lid, having a generally cylindrical body portion and at at least one axial end thereof a flanging rim, wherein said flanging rim comprises, successively in the axial direction away from said body portion, a first portion of gradually increasing wall thickness, a second portion of maximum wall thickness, a third portion of gradually decreasing wall thickness and a fourth portion of constant wall thickness which is less than said maximum wall thickness.

14. A method of forming a metal packaging can body comprising (a) deep drawing and ironing a metal blank to form can body having a can body portion of generally cylindrical shape and a flanging rim at one axial end thereof, said flanging rim having a portion of maximum wall thickness greater than that of the body portion and having, axially more remote from said body portion than said portion of maximum wall thickness, a portion which decreases in wall thickness in the axial direction away from said body portion, and (b) trimming said can body by removing a part of said flanging rim while leaving at least part of said portion of maximum wall thickness.

* * * * *

UNITED STATES PATENT AND TRADEMARK OFFICE

CERTIFICATE OF CORRECTION

PATENT NO. : 4,905,859

DATED : Mar. 6, 1990

INVENTOR(S) : Frederik Jonker

It is certified that error appears in the above-identified patent and that said Letters Patent is hereby corrected as shown below:

The title page showing the illustrative figure should be deleted and substitute therefor the attached title page.

Signed and Sealed this

Twelfth Day of November, 1991

*Attest:*

HARRY F. MANBECK, JR.

*Attesting Officer*

*Commissioner of Patents and Trademarks*

United States Patent [19]

Jonker

[11] Patent Number: 4,905,859

[45] Date of Patent: Mar. 6, 1990

[54] METAL PACKAGING CAN AND METHOD OF MAKING IT

[75] Inventor: Frederik Jonker, Heemskerk, Netherlands

[73] Assignee: Hoogovens Groep B.V., Ijmuiden, Netherlands

[21] Appl. No.: 366,533

[22] Filed: Jun. 15, 1989

[30] Foreign Application Priority Data

Jun. 27, 1988 [NL] Netherlands ..... 8801625

[51] Int. Cl.[4] ..... B65D 8/00

[52] U.S. Cl. ..... 220/67

[58] Field of Search ..... 220/83, 1 BC, 66, 67, 220/74, 76, 79

[56] References Cited

U.S. PATENT DOCUMENTS

| | | | |
|---|---|---|---|
| 1,323,254 | 12/1919 | Downs | 220/67 |
| 2,196,206 | 4/1940 | Foss | 220/67 |
| 2,432,790 | 12/1947 | O'Larte et al. | 220/67 X |
| 3,709,399 | 1/1973 | Hughes | 220/67 |

FOREIGN PATENT DOCUMENTS 2464887 3/1981 France .

OTHER PUBLICATIONS

H. Fujimori, "Forming Method for Can Opening Part, and Roll Forming Device Used for said Method", Patent Abstracts of Japan, vol. 7, No. 250(M-254)1395 11/8/83.

*Primary Examiner*—Steven M. Pollard

*Attorney, Agent, or Firm*—Stevens, Davis, Miller & Mosher

[57] ABSTRACT

Metal packaging can body, for use in forming a can by attachment of at least one lid, has a generally cylindrical body portion and a flanging rim which is intended for the subsequent attachment of the body portion to the lid. The flanging rim is at least partly of wall thickness greater than that of the body portion. To save material and costs, the flanging rim has at least one portion which decreases in wall thickness in the axial direction away from said body portion. The invention is especially applicable to deep-drawn and ironed products.

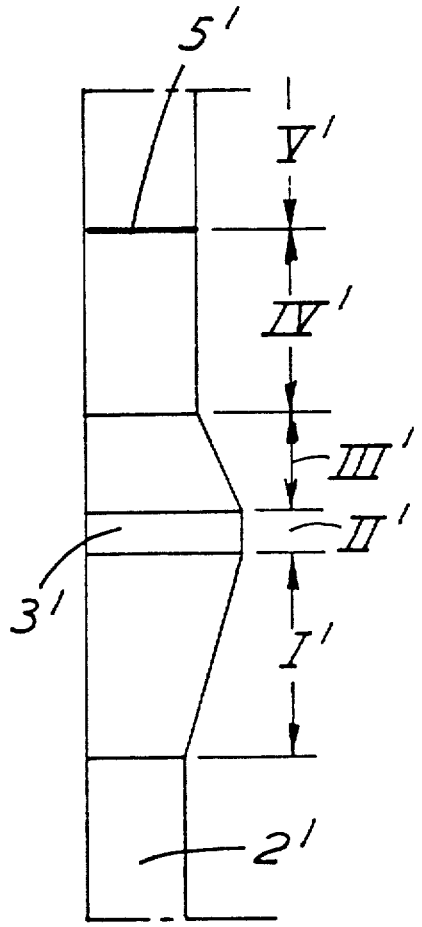

14 Claims, 1 Drawing Sheet